US005488744A

United States Patent [19]

Paananen

[11] Patent Number: 5,488,744

[45] Date of Patent: Feb. 6, 1996

[54] AUTOMATIC TOILET SEAT ACTUATOR

[76] Inventor: Paul A. Paananen, 1822 M-64, Ontonagon, Mich. 49953

[21] Appl. No.: 292,382

[22] Filed: Aug. 18, 1994

[51] Int. Cl.[6] ..... A47K 13/10

[52] U.S. Cl. ..... 4/246.2

[58] Field of Search ..... 4/248, 249, 250, 4/408, 409, 468, 473, 486, 246.1, 246.2

[56] References Cited

U.S. PATENT DOCUMENTS 2,200,687 5/1940 Bercot ..... 4/246.1
3,780,384 12/1973 Rivelle ..... 4/408 X
4,055,864 11/1977 Liu et al. ..... 4/246.1 X
4,912,783 4/1990 Shafer ..... 4/246.1
5,060,318 10/1991 Jaskiewicz ..... 4/248 X

*Primary Examiner*—Charles E. Phillips

[57] ABSTRACT

A toilet seat actuator for automatically lowering a toilet seat in response to the movement of the flush handle of the toilet. The inventive device includes a dampener assembly coupled to both the base of the toilet and the toilet seat. A pull chain extends between the flush handle and the dampener assembly such that actuation of the flush handle rotates the dampener to initiate lowering of the seat, whereby gravity effects complete lowering of the seat against the friction of the dampener.

9 Claims, 4 Drawing Sheets

AUTOMATIC TOILET SEAT ACTUATOR

BACKGROUND OF THE INVENTION

1. Field of the Invention

The present invention relates to toilet structures and more particularly pertains to an automatic toilet seat actuator for lowering a toilet seat in response to a movement of the flush handle of the toilet.

2. Description of the Prior Art

The use of toilet structures is known in the prior art. More specifically, toilet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet structures include U.S. Pat. Nos. 4,912,783; 4,584,724; 4,291,422; 2,155,548; 2,902,707; 2,011,404; 1,509,242; 5,014,367; 5,056,165; 5,101,518; 5,177,818; and 5,237,708.

While these devices fulfill their respective, particular objectives and requirements, the aforementioned patents do not disclose a toilet seat actuator for automatically lowering a toilet seat in response to a movement of the flush handle of the toilet which includes a dampener assembly coupled to both the base of the toilet and the toilet seat, with a pull chain extending between the flush handle and the dampener assembly such that actuation of the flush handle rotates the dampener to initiate lowering of the seat, whereby gravity effects complete lowering of the seat against the friction of the dampener.

In these respects, the automatic toilet seat actuator according to the present invention substantially departs from the conventional concepts and designs of the prior art, and in so doing provides an apparatus primarily developed for the purpose of automatically lowering a toilet seat in response to a movement of the flush handle of the toilet.

SUMMARY OF THE INVENTION

In view of the foregoing disadvantages inherent in the known types of toilet structures now present in the prior art, the present invention provides a new automatic toilet seat actuator construction wherein the same can be utilized for automatically lowering a toilet seat in response to a movement of the flush handle of the toilet. As such, the general purpose of the present invention, which will be described subsequently in greater detail, is to provide a new automatic toilet seat actuator apparatus and method which has many of the advantages of the toilet structures mentioned heretofore and many novel features that result in an automatic toilet seat actuator which is not anticipated, rendered obvious, suggested, or even implied by any of the prior art toilet structures, either alone or in any combination thereof.

To attain this, the present invention generally comprises a toilet seat actuator for automatically lowering a toilet seat in response to the movement of the flush handle of the toilet. The inventive device includes a dampener assembly coupled to both the base of the toilet and the toilet seat. A pull chain extends between the flush handle and the dampener assembly such that actuation of the flush handle rotates the dampener to initiate lowering of the seat, whereby gravity effects complete lowering of the seat against the friction of the dampener.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic toilet seat actuator apparatus and method which has many of the advantages of the toilet structures mentioned heretofore and many novel features that result in an automatic toilet seat actuator which is not anticipated, rendered obvious, suggested, or even implied by any of the prior art toilet structures, either alone or in any combination thereof.

It is another object of the present invention to provide a new automatic toilet seat actuator which may be easily and efficiently manufactured and marketed.

It is a further object of the present invention to provide a new automatic toilet seat actuator which is of a durable and reliable construction.

An even further object of the present invention is to provide a new automatic toilet seat actuator which is susceptible of a low cost of manufacture with regard to both materials and labor, and which accordingly is then susceptible of low prices of sale to the consuming public, thereby making such automatic toilet seat actuators economically available to the buying public.

Still yet another object of the present invention is to provide a new automatic toilet seat actuator which provides in the apparatuses and methods of the prior art some of the advantages thereof, while simultaneously overcoming some of the disadvantages normally associated therewith.

Still another object of the present invention is to provide a new automatic toilet seat actuator for automatically lowering a toilet seat in response to a movement of the flush handle of the toilet.

Yet another object of the present invention is to provide a new automatic toilet seat actuator which includes a dampener assembly coupled to both the base of the toilet and the toilet seat, with a pull chain extending between the flush handle and the dampener assembly such that actuation of the flush handle rotates the dampener to initiate lowering of the seat, whereby gravity effects complete lowering of the seat against the friction of the dampener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
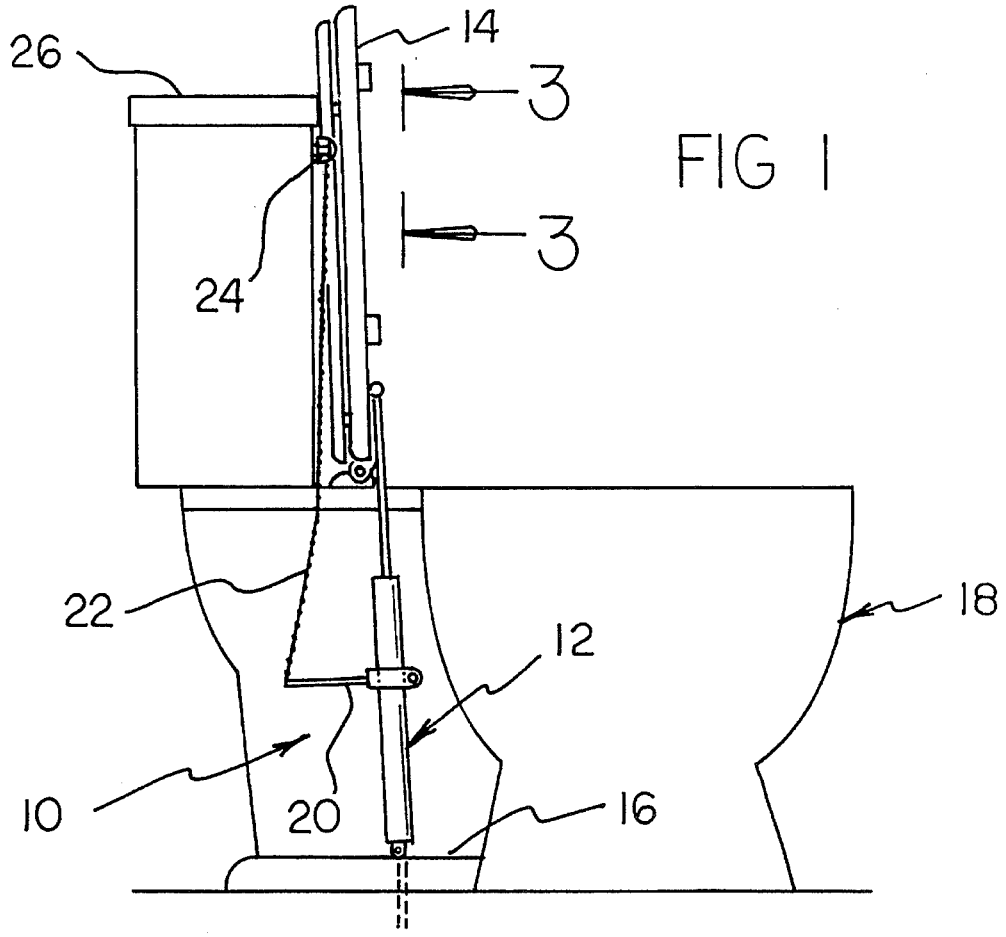
FIG. 1 is a side elevation view of an automatic toilet seat actuator according to the present invention.
Figure 2:
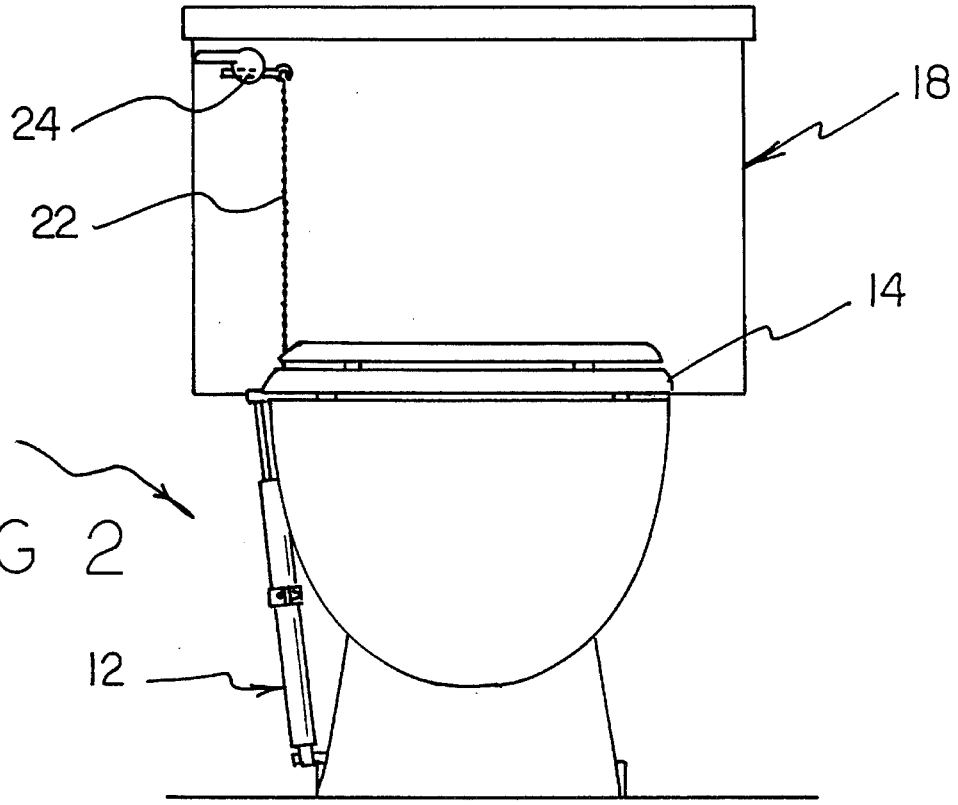
FIG. 2 is a front elevation view thereof.

With reference now to the drawings, and in particular to FIGS. 1–7 thereof, a new automatic toilet seat actuator embodying the principles and concepts of the present invention and generally designated by the reference numeral 10 will be described.

Figure 3:
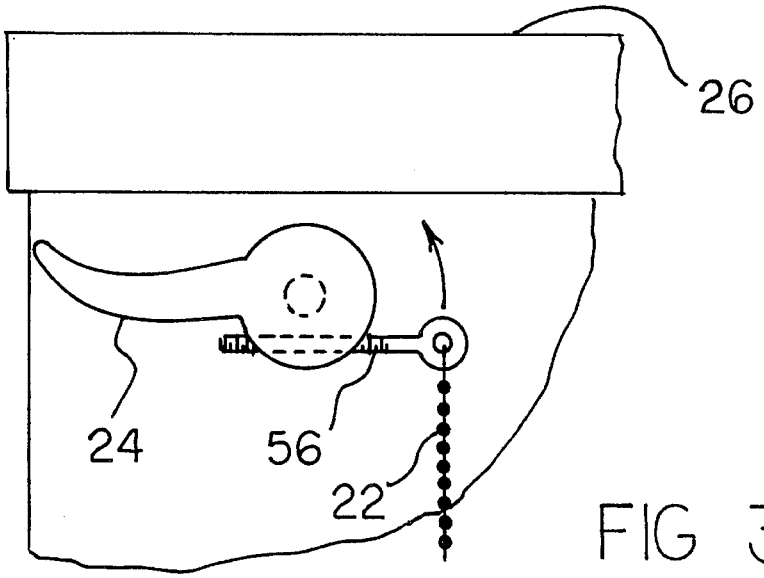
FIG. 3 is an enlarged front elevation view of a portion of the invention viewed from line 3—3 of FIG. 1.
Figure 4:
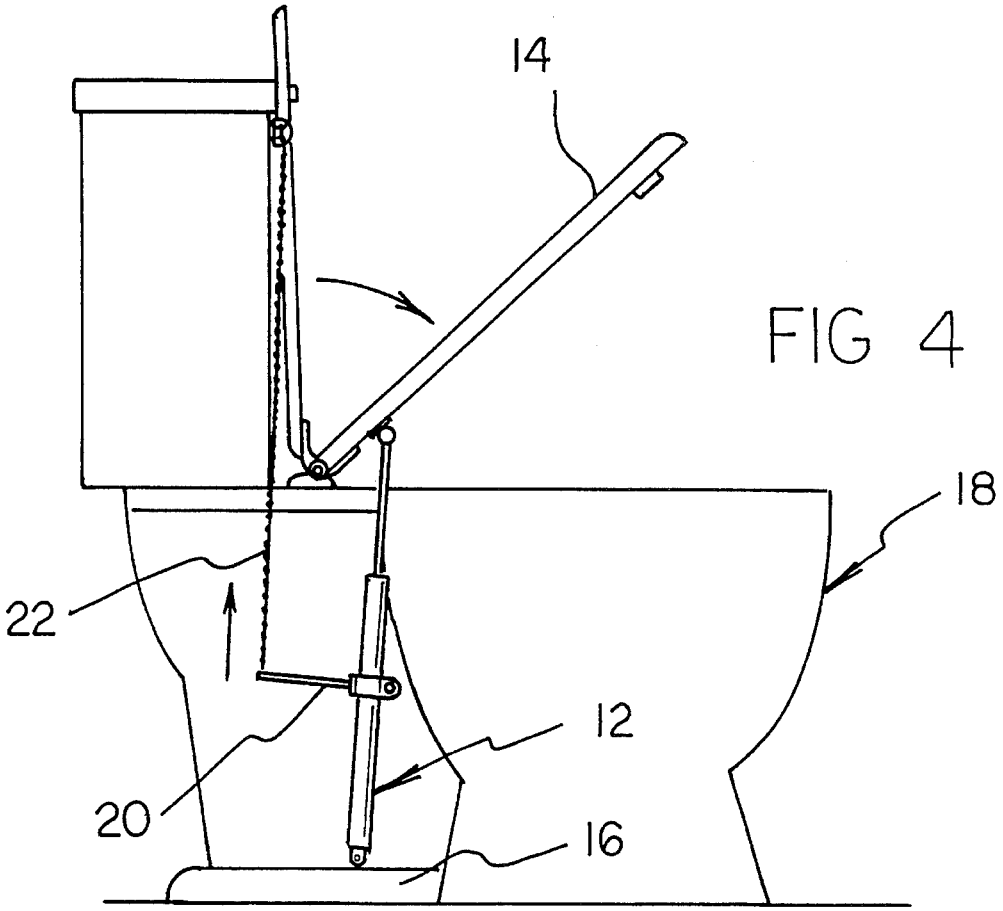
FIG. 4 is a side elevation view of the present invention during lowering of the toilet seat.
Figure 5:
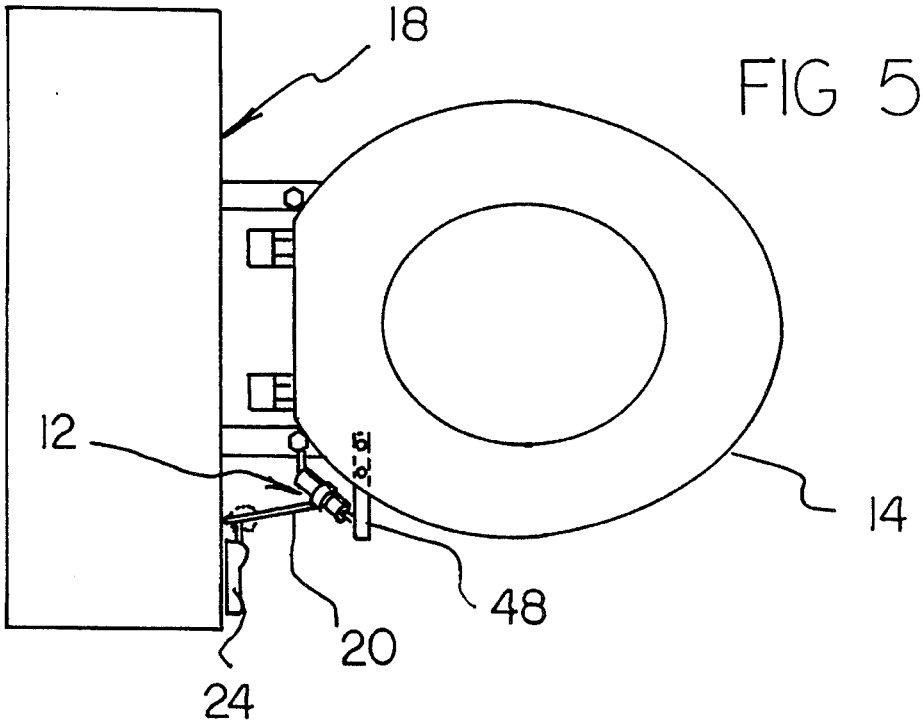
FIG. 5 is a top plan view of the present invention with the toilet seat in the lowered position.
Figure 6:
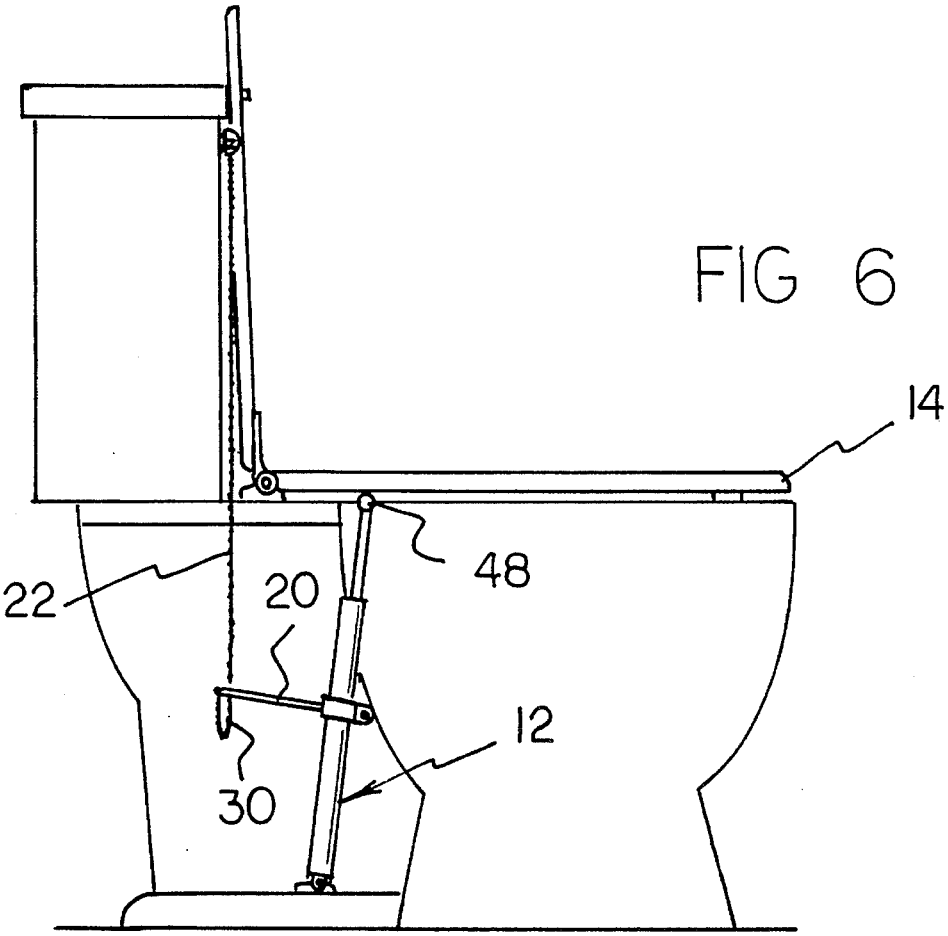
FIG. 6 is a side elevation view of the invention.

More specifically, it will be noted that the automatic toilet seat actuator 10 comprises a dampener assembly means 12 for pivoting and frictionally retarding a motion of an associated toilet seat 14. The dampener assembly 12 is mounted to a base 16 of a toilet 18 and extends from the base to couple with a lower surface of the toilet seat 14, as best illustrated in FIG. 1. The dampener assembly 12 includes an orthogonally projecting lever 20 to which a pull chain 22 is attached. The pull chain 22 extends from the outer distal end of the lever 20 and is mechanically coupled to the flush handle 24 of the toilet 18, as shown in FIG. 3. By this structure, a rotation of the flush handle 24 will tension the pull chain 22 in the direction illustrated in FIG. 4, thereby upwardly biasing the lever 20 and causing the dampener assembly 12 to rotate relative to the base 16 of the toilet 18. Such rotation of the dampener assembly means 12 will bias the toilet seat 14 away from the toilet tank 26 to initiate lowering of the seat. After the initial biasing of the toilet seat 14 away from the toilet tank 26 against which it leans when in the up position, the toilet seat will continue to rotate under a force of gravity and against a frictional force of the dampener assembly 12 to slowly lower into the horizontal position illustrated in FIGS. 5 and 6. When the toilet seat 14 is positioned in the horizontal orientation illustrated in FIG. 6, the pull chain 22 will hang downwardly from the flush handle 24 and include slack as at 30 which permits free rotation of the flush handle 24 without interference from the lever 20 of the dampener assembly means 12. Thus, with the toilet seat 14 in the horizontal position, the automatic toilet seat actuator 10 does not affect normal operation of the toilet 18.

Figure 7:
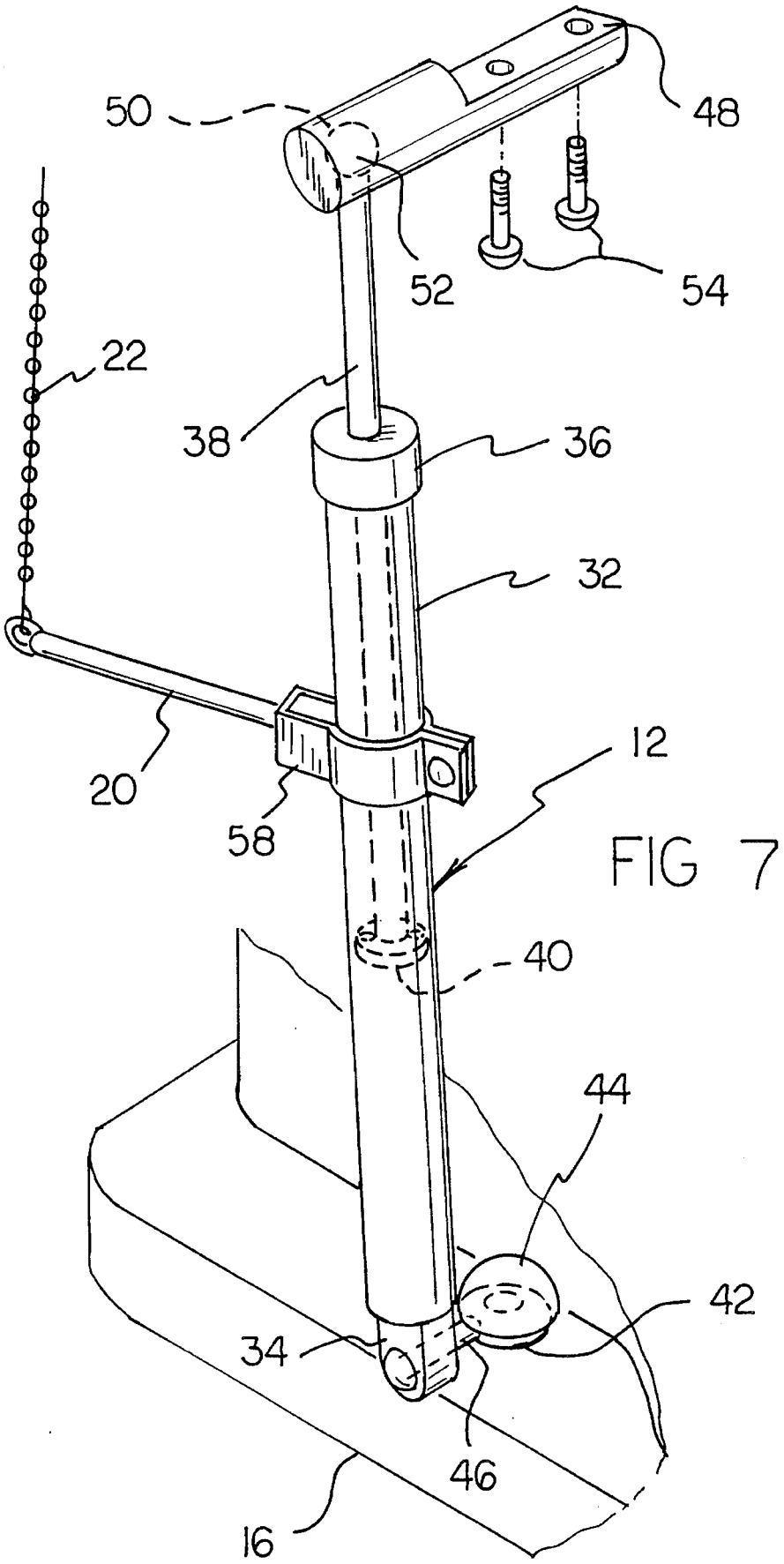
FIG. 7 is an enlarged isometric illustration of a portion of the invention.

Turning now to FIG. 7, the dampening assembly means 12 is illustrated in detail. As shown, the dampening assembly means 12 comprises a substantially hollow cylinder 32 having a cylinder mount 34 at a lower end of the cylinder and a cylinder seal 36 at a top end of the cylinder. The cylinder 32 is substantially fluid tight, with the seal 36 permitting a sealing projection of a plunger 38 into the interior of the cylinder such that the plunger 38 can be reciprocated relative to the cylinder 32 through the seal 36. A piston 40 is mounted to a lower distal end of the plunger 38 within the cylinder 32 and includes a plurality of unlabelled through-extending holes which permit a regulated passage of fluid from a first side of the piston to a second side of the piston. The piston 40 is preferably sealingly engaged to an interior wall surface of the cylinder 32 such that fluid present on the first side of the piston 40 must pass through the holes therein during movement of the plunger 38. By this structure, movement of the plunger 38 is frictionally retarded relative to the cylinder 32. The cylinder 32 may include therein a fluid such as oil or the like, or alternatively may simply contain air, with such air providing the frictional resistance against movement of the piston 40 and the associated plunger 38 relative to the cylinder 32.

With continuing reference to FIG. 7, it can be shown that the dampening assembly means 12 further comprises a mounting plate 42 of substantially planar configuration and having a through-extending aperture facilitating attachment of the mounting plate to the toilet mounting bolt 44 typically utilized to attach the toilet 18 to the floor surface therebeneath. A pivot pin 46 extends from the mounting plate 42 and is rotatably coupled to the cylinder mount 34 such that rotation of the dampening assembly means 12 relative to the toilet base 16 is permitted.

To facilitate mounting of the upper distal end of the plunger 38 to the toilet seat 14, a toilet mount 48 is pivotally mounted to the upper distal end of the plunger. To this end, the toilet amount 48 includes a substantially spherical socket 50 which receives a sphere 52 formed in the upper distal end of the plunger 38. Further, the toilet mount 48 includes at least one through-extending mounting hole permitting at least one fastener 54 to be directed therethrough and threadably engaged to the toilet seat 14 in a well understood manner.

Referring now to FIG. 3, with concurrent reference to FIG. 7, it can be shown that the pull chain 22 is mechanically coupled to the flush handle 24 by a coupler 56 which extends into and is threadably engaged to the flush handle. Preferably, the coupler 56 comprises an eye-bolt threadably directed into a portion of the flush handle. The pull chain 22 extends from the eye of the coupler 56 and, referring now back to FIG. 7, is coupled to an outer distal end of the lever 20. The lever 20 is coupled at its inner proximal end to a lever mount 58 which extends around and clamps onto the cylinder 32 substantially as shown.

In use, the automatic toilet seat actuator 10 may be readily attached to a conventionally existing toilet 18 so as to extend between the toilet base 16 and the toilet seat 14. Thus, when the toilet seat 14 is leaning against the tank 26, as illustrated in FIG. 1, the pull chain 22 will be substantially taut, whereby actuation of the flush handle 24 will tension the pull chain to cause a pivoting of the dampener assembly means 12 which will pull the toilet seat 14 away from the tank 26. The toilet seat 14 will then continue lowering against a dampening force of the dampener assembly means 12 to quietly land into a horizontal position illustrated in FIG. 6. The device 10 effectively ensures that the toilet seat 14 is always positioned in the lowered or horizontal orientation desirable by many toilet users.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An automatic toilet seat actuator comprising:

a dampener assembly means for pivoting and frictionally retarding a motion of a toilet seat of a toilet, said dampener assembly means being mountable to said toilet so as to extend between a portion of said toilet and said toilet seat;

and, means for mechanically coupling said dampener assembly means to a flush handle of said toilet such that a rotation of said flush handle with said toilet seat in a raised position will pivot said dampener assembly relative to said toilet so as to pivot said toilet seat towards a closed position, whereby said toilet seat will continue to rotate under a force of gravity and against a frictional force of said dampener assembly to lower into said closed position, said means for mechanically coupling said dampener assembly means to a flush handle of said toilet comprising a pull chain having a first end mechanically couplable to the flush handle, the pull chain including a second end mechanically coupled to the dampening means such that a tensioning of the pull chain will directly pull the dampening means relative to the toilet to pivot the dampening means relative to the toilet.

2. The automatic toilet seat actuator of claim 1, wherein said dampener assembly means comprises a substantially hollow cylinder pivotally mountable to said portion of said toilet, said cylinder being substantially fluid tight; a seal secured to an upper portion of said cylinder; a plunger projecting through said seal and into an interior of said cylinder; a piston mounted to a lower distal end of said plunger within said cylinder, said piston being operable to frictionally resist movement of said plunger within said cylinder, said plunger being couplable to said toilet seat.

3. The automatic toilet seat actuator of claim 2, wherein said dampening assembly means further comprises a mounting plate of substantially planar configuration and having a through-extending aperture facilitating attachment of said mounting plate to a toilet mounting bolt; a pivot pin extending from said mounting plate and rotatably coupled to said cylinder.

4. The automatic toilet seat actuator of claim 3, wherein an upper distal end of said plunger is shaped so as to define a sphere; and further comprising a toilet mount having a substantially spherical socket receiving said sphere of said plunger, said toilet mount including at least one through-extending mounting hole permitting at least one fastener to be directed therethrough and threadably engaged to said toilet seat.

5. An automatic toilet seat actuator comprising:

a dampener assembly means for pivoting and frictionally retarding a motion of a toilet seat of a toilet, said dampener assembly means being mountable to said toilet so as to extend between a portion of said toilet and said toilet seat, said dampener assembly means comprising a substantially hollow cylinder pivotally mountable to said portion of said toilet, said cylinder being substantially fluid tight; a seal secured to an upper portion of said cylinder; a plunger projecting through said seal and into an interior of said cylinder; a piston mounted to a lower distal end of said plunger within said cylinder, said piston being operable to frictionally resist movement of said plunger within said cylinder, said plunger being couplable to said toilet seat, said dampening assembly means further comprising a mounting plate of substantially planar configuration and having a through-extending aperture facilitating attachment of said mounting plate to a toilet mounting bolt; a pivot pin extending from said mounting plate and rotatably coupled to said cylinder, said plunger being shaped so as to define a sphere at an upper distal end thereof;

a toilet mount having a substantially spherical socket receiving said sphere of said plunger, said toilet mount including at least one through-extending mounting hole permitting at least one fastener to be directed therethrough and threadably engaged to said toilet seat;

and, means for mechanically coupling said dampener assembly means to a flush handle of said toilet such that a rotation of said flush handle with said toilet seat in a raised position will pivot said dampener assembly relative to said toilet so as to pivot said toilet seat towards a closed position, whereby said toilet seat will continue to rotate under a force of gravity and against a frictional force of said dampener assembly to lower into said closed position, said means for mechanically coupling said dampener assembly means to a flush handle of said toilet comprising a pull chain; an eye-bolt mechanically coupled to said pull chain, said eye-bolt being threadably engagable to said flush handle; a lever, said pull chain being coupled to an outer distal end of said lever, with an inner end of said lever being coupled to said cylinder.

6. An automatic toilet seat actuator comprising:

a toilet having a toilet seat pivotally mounted thereto and a flush handle;

a dampener assembly means for pivoting and frictionally retarding a motion of the toilet seat of the toilet, said dampener assembly means being mounted to said toilet so as to extend between a portion of said toilet and said toilet seat;

and, means for mechanically coupling said dampener assembly means to the flush handle of said toilet such that a rotation of said flush handle with said toilet seat in a raised position will directly pivot said dampener assembly relative to said toilet so as to pivot said toilet seat towards a closed position, whereby said toilet seat will continue to rotate under a force of gravity and against a frictional force of said dampener assembly to lower into said closed position, said means for mechanically coupling said dampener assembly means to a flush handle of said toilet comprising a pull chain having a first end mechanically coupled to the flush handle, the pull chain including a second end mechanically coupled to the dampening means such that a tensioning of the pull chain will directly pull the dampening means relative to the toilet to pivot the dampening means relative to the toilet.

7. The automatic toilet seat actuator of claim 6, wherein said dampening assembly means comprises a substantially hollow cylinder pivotally mountable to said portion of said toilet, said cylinder being substantially fluid tight; a seal secured to an upper portion of said cylinder; a plunger projecting through said seal and into an interior of said cylinder; a piston mounted to a lower distal end of said plunger within said cylinder, said piston being operable to frictionally resist movement of said plunger within said cylinder, said plunger being couplable to said toilet seat.

8. The automatic toilet seat actuator of claim 7, wherein said dampening assembly means further comprises a mounting plate attached to a toilet mounting bolt of the toilet; and a pivot pin extending from said mounting plate and rotatably coupled to said cylinder.

9. The automatic toilet seat actuator of claim 8, wherein an upper distal end of said plunger is shaped so as to define a sphere; and further comprising a toilet mount having a substantially spherical socket receiving said sphere of said plunger, said toilet mount being engaged to said toilet seat.

* * * * *